United States Patent [19]

Schattel

[11] Patent Number: 4,962,873

[45] Date of Patent: Oct. 16, 1990

[54] MATERIALS HANDLING DEVICE

[76] Inventor: John L. Schattel, 3106 Honey Tree La., Austin, Tex. 78746

[21] Appl. No.: 445,959

[22] Filed: Dec. 4, 1989

[51] Int. Cl.[5] ..... A45F 5/00

[52] U.S. Cl. ..... 224/226; 224/268; 224/904

[58] Field of Search .....294/26, 167; 224/157, 224/226, 268, 904

[56] References Cited

U.S. PATENT DOCUMENTS

| | | | |
|---|---|---|---|
| 285,510 | 9/1883 | Perry | 224/268 X |
| 580,949 | 4/1897 | Murphy | 294/26 |
| 2,651,441 | 9/1953 | Rau et al. | 224/268 X |
| 2,753,100 | 7/1956 | Montgomery | 224/268 X |
| 2,856,111 | 10/1958 | Wolfe et al. | 224/268 |
| 3,809,349 | 11/1974 | Baedke | 224/268 |
| 4,325,503 | 1/1982 | Swinney | 224/268 |
| 4,496,088 | 2/1985 | Tuthill | 24/904 |
| 4,523,702 | 9/1985 | Viio | 224/904 |
| 4,621,753 | 3/1986 | Ridings | 224/904 |
| 4,638,530 | 8/1987 | Perry | 224/904 |
| 4,641,874 | 2/1987 | Grenzer | 224/268 X |
| 4,747,527 | 5/1988 | Trumpower | 224/224 |
| 4,826,059 | 5/1989 | Bosch et al. | 224/904 X |

*Primary Examiner*—Henry J. Recla
*Assistant Examiner*—Robert M. Fetsuga

[57] ABSTRACT

A tool for transporting metal rebar and other similar construction materials to the place where the materials are needed. The tool comprises a base 20 which contains a hook mounting hole 48 through which a hook 22 is installed and permanently attached by means of snap ring retainers 26. The hook has the capability of being rotated one hundred and eighty degrees as measured from the base and has positioning detents 50 at 0 degrees, 90 degrees, and 180 degrees. The entire hook assembly is attached to a customized belt 30 by means of fasteners through attaching holes 54. The belt has shoulder straps 32 and a chest strap 40 mounted on the belt. The belt and harness are adjustable by means of a plurality of buckles 38, 42, 44, and an adjustable shoulder strap retainer 36. The belt has the means 52 of attaching the customary tools used by iron workers.

2 Claims, 3 Drawing Sheets

MATERIALS HANDLING DEVICE

1. Field of Invention

This invention relates to material handling, particularly to materials handled in the construction industries such as metal rebar used in concrete construction. The invention facilitates the ease of moving this type of material and minimizes fatigue and risk of back injury to workers.

2. Description of Prior Art

Most construction companies involved in heavy construction who utilize concrete as a building material have a major problem with worker fatigue and back injury due to overexertion. One of the reasons that these problems surface is that rebar, the steel reinforcing used to prevent the concrete from coming apart, and other similar very heavy and hard to move objects, are very difficult to move from unloading areas to sites where they are needed. In most cases the rebar, or other similar material, is moved manually utilizing two workers acting as a team. Each person on the team must work in unison with the other member and pick the material up from the ground, place it on their shoulders, and carry it to where it's needed. The number of lengths of the rebar or similar material carried by the team on each trip will depend on the diameter and length of each piece. Generally, the number will be about three or four pieces per trip.

In order to facilitate movement of construction materials similar to rebar, most workers would find it desirable to have a material handling device capable of assisting in moving the material from one place to another.

Heretofore there has not been a personnel mounted material handling device proposed which is capable of assisting workers to move construction materials similar to rebar from one place to another. However, there are some which have been designed to be attached to a persons belt and used to carry small hand tools, and the like, which are totally unsatisfactory for the task of moving construction materials.

OBJECTS AND ADVANTAGES

Accordingly, I claim the following as my objects and advantages of the invention: to provide a tool for easily and reliably moving rebar and other similar construction materials from one place to another, to provide a tool which will increase the safety of the worker by minimizing the risk of overexertion and back injury, and to provide a tool, when combined with a properly constructed belt, will result in a reduction of worker fatigue due to the requirement for less lifting. This tool and belt combination will also become a convenient and comfortable carrier for the customary tools required for iron workers to perform concrete construction work. This will result in greater productivity since the worker will be less fatigued and tools will be in a convenient position for use when needed. It will assist increasing productivity since the worker will be on the job and not recuperating from back strain or other injury. Efficiency of the company will also be increased since the costs of hiring and training a new employee to replace the injured worker will not be necessary.

Readers will find further objects and advantages of the invention from a consideration of the ensuing description and the accompanying drawings.

Figure 1:
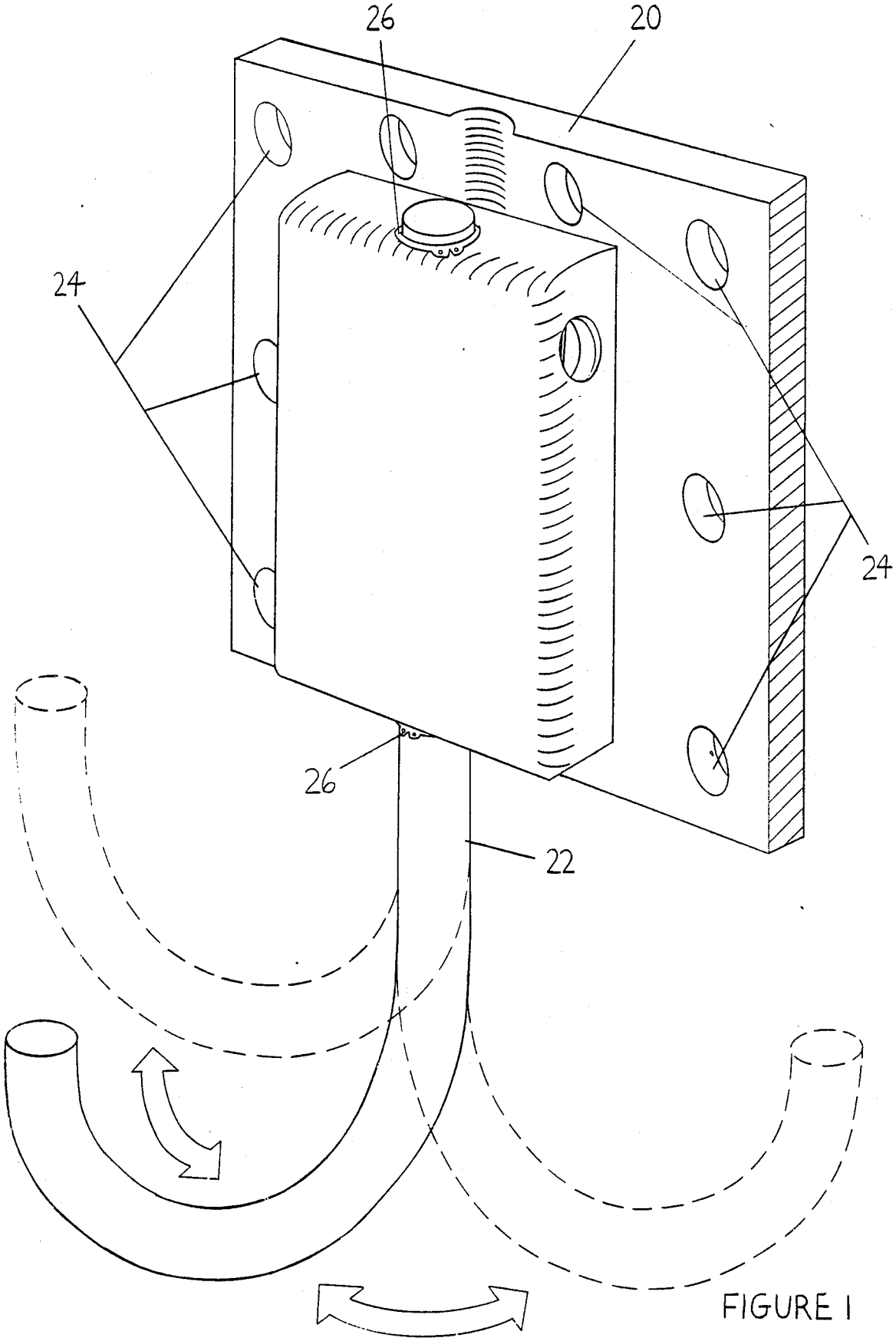
FIG. 1 shows a front view perspective of such tool according to the invention.

DRAWING REFERENCE NUMERALS 20 base
22 hook
24 hole (6)
26 snap ring retainer
28 standard spring powered ball plunger
30 belt
32 shoulder strap
34 adjustable shoulder pad
36 adjustable shoulder strap retainer
38 shoulder strap adjustment buckle
40 chest strap
42 chest strap adjustment buckle
44 belt adjustment buckle
46 belt comfort padding
48 hook mounting hole
50 hook positioning detents
52 tool attachment points
54 hook assembly attachment holes

SINGLE-PIECE TOOL-DESCRIPTION

Figure 2:
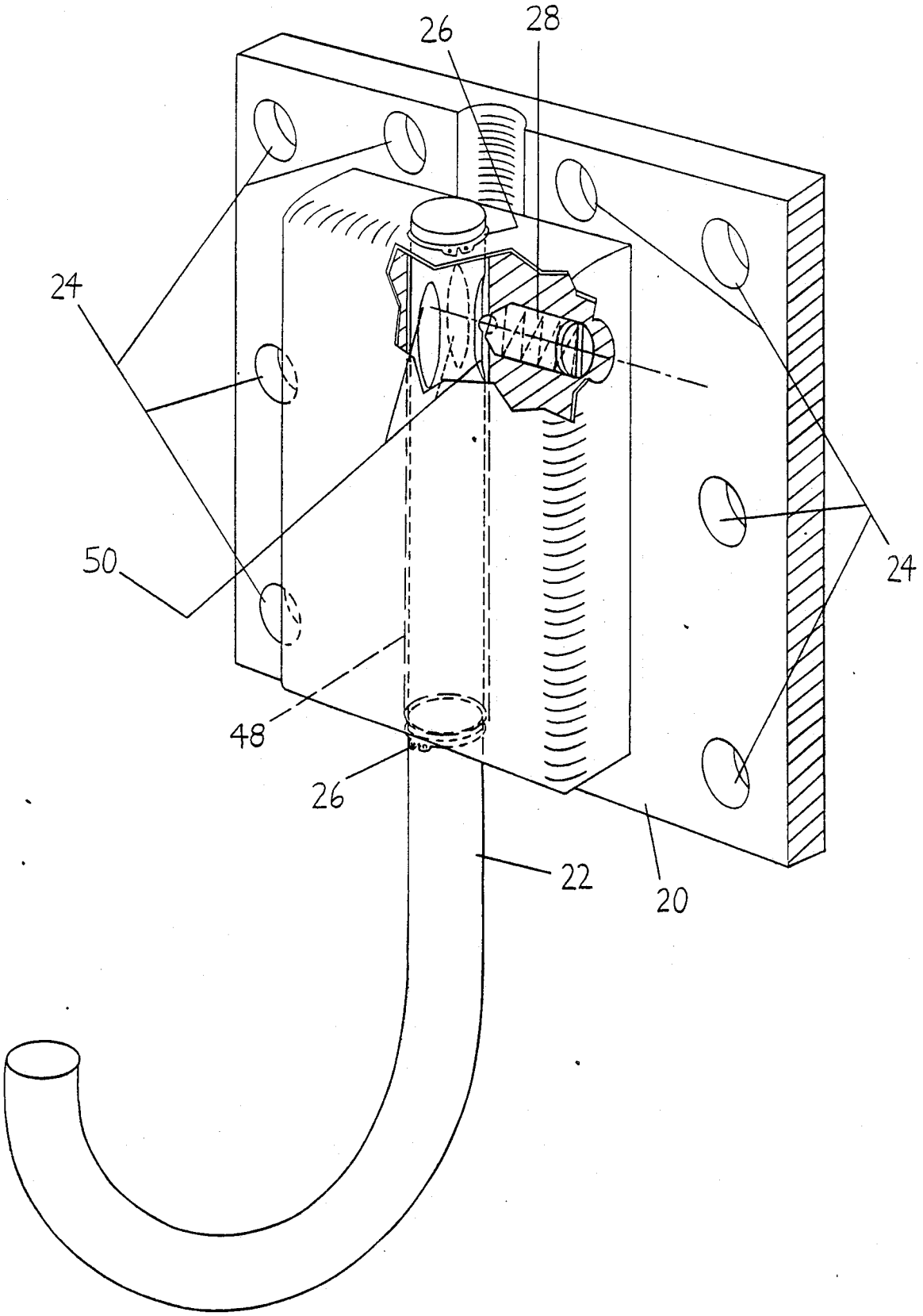
FIG. 2 shows a cutaway view of such tool according to the invention.

FIG. 1 shows a single-piece tool according to the preferred embodiment of the invention. The tool comprises a base 20 preferably made of aluminum which has 6 holes 24 around its edge for attaching the base by use of fasteners to a belt. The tool also has a hole 48 FIG. 2 of sufficient size to accept a shaft of a hook 22 which is preferably made of one half inch 10/8 CRS bar stock. The hook is held in the hole and attached to the base by snap ring retainers 26 at each end of the hole in the base. The hook has the capability of being rotated through 180 degrees and has positioning detents 50 FIG. 2 at 0 degrees, 90 degrees, and 180 degrees, as measured outward from the base. The hook positioning detent 50 FIG. 2 is comprised of 3 detents on the hook shaft which engage a standard spring powered ball plunger 28 FIG. 2 mounted in the base of the tool. The entire assembly is mounted on a suitable belt FIG. 3 by using manual fasteners which are placed in a series of hook assembly attachment holes 54, FIG. 3 located in the area where the belt crosses either side of the wearer. The belt is described as follows.

Figure 4:
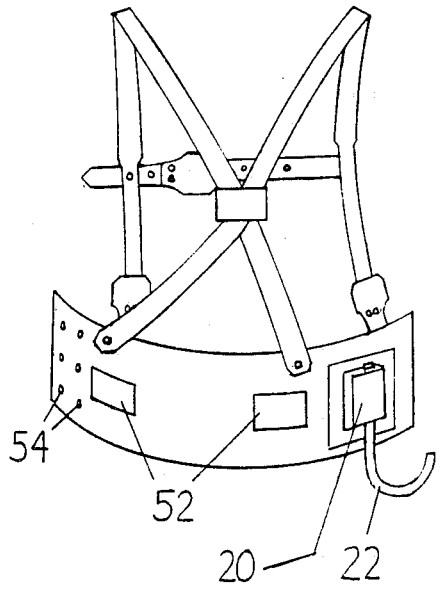
FIG. 4 shows a view from the rear indicating mounting of the material handling device and the positions where provision for tool attachments may be made.

The belt is constructed of a material, preferably thick leather, or other sufficiently durable material to support the weight of the rebar and other similar materials, as well as other tools customarily used by iron workers. The inside of the belt is covered with comfort padding 46 FIG. 3 of sufficient thickness to provide comfort to the wearer. The belt should be of sufficient width to accommodate mounting of the tool assembly FIG. 1 on the belt 30 FIG. 3. The belt has an adjustment buckle 44 FIG. 3 to adjust the length to fit the wearer. It is widened in the rear where the belt contacts the small of the back sufficiently to provide comfortable support to the lower back. Included on the belt is a means of attaching the customary tools used by iron workers 52 FIG. 4.

Figure 3:
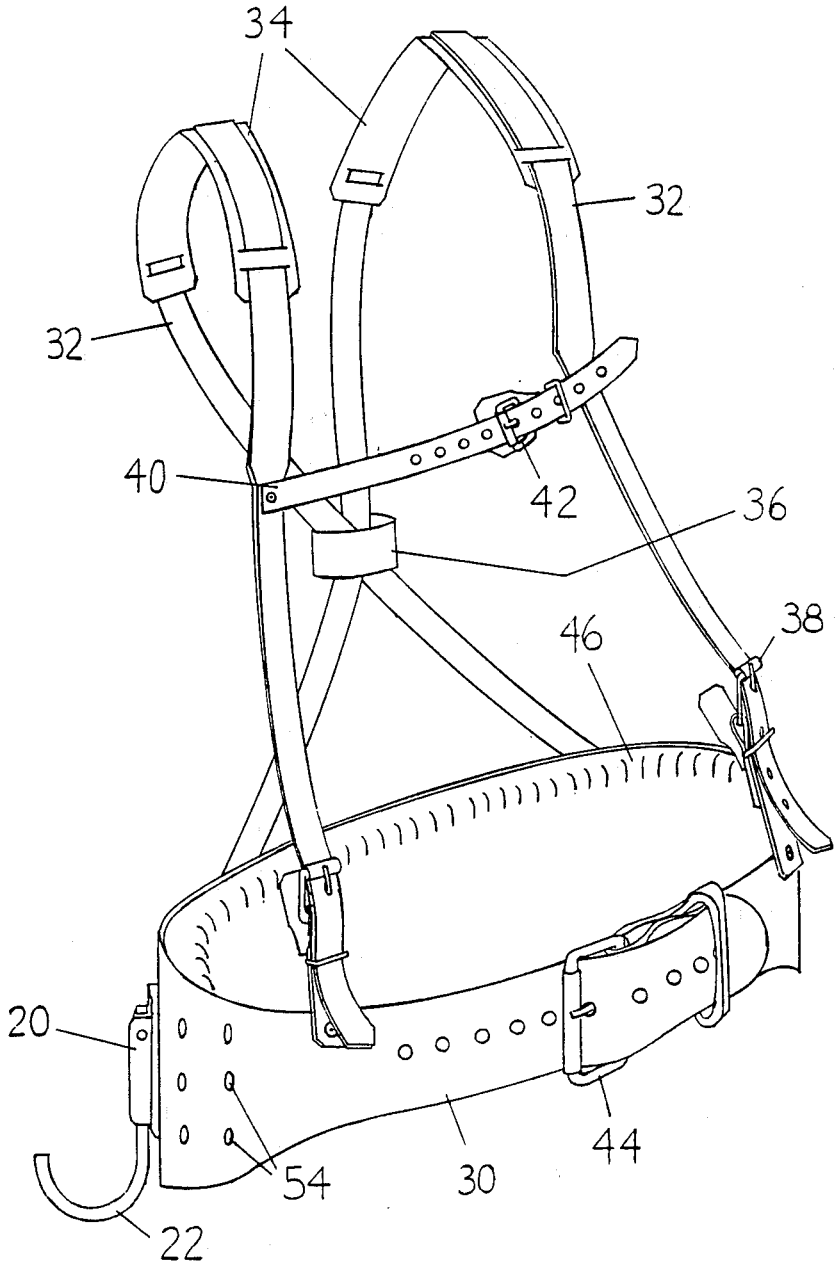
FIG. 3 shows such tool according to the invention mounted on a customized belt.

Attached to the belt are two shoulder straps 32 FIG. 3. The shoulder straps include adjustable shoulder pads 34 FIG. 3 and the shoulder straps are adjustable by using the two shoulder strap adjustment buckles 38 FIG. 3. An adjustable shoulder strap retainer 36 FIG. 3 is provided where the two straps cross in the back. Attached to the shoulder straps in an adjustable chest strap 40 FIG. 3 which has a chest strap adjustment buckle 42 FIG. 3.

SINGLE-PIECE TOOL-OPERATION

The single-piece tool of FIG. 1 will perform several operations, the most preferred being the manual transporting of construction rebar from one location to another in a safe and efficient manner.

In order to use the tool properly, the user must first make several adjustments to the belt and harness as well as the tool itself. The first step is to put on the harness and belt FIG. 3 and make required adjustment to fit the belt and harness snugly to the body. This adjustment is made by first snugging down the belt adjustment buckle 44 to a comfortable level. Then adjust the shoulder straps 32 by using the shoulder strap adjustment buckles 38. During this step insure that the adjustable shoulder pads 34 are correctly positioned and that the adjustable shoulder strap retainer 36 is positioned where the shoulder straps cross over the shoulders at a comfortable angle. After the shoulder straps are properly adjusted, fasten the chest strap 40 by adjusting the chest strap adjustment buckle 42. Then attach the material handling devise FIGS. 1, 3, on the belt using fasteners at the appropriate side of the user. The appropriate side is determined by the following: Left side of the body if left-handed, and right side of the body if right-handed. After attaching the material handler insure that the hook 22 is in the outward position or ninety degrees from the base 20. Once these steps are taken, insure that a co-worker has also put on a material handling device so that both workers can work as a team and move the rebar where it is needed.

This is accomplished in the following manner. The team should move to the pile of rebar and both take a position on the same side of the pile of rebar or other similar type of material at about the one third point from the end of the length of rebar. Each should be standing facing the pile of rebar. The team should squat down in unison and the team leader determine which lengths of rebar to pick up by grabbing the rebar to be picked up. The other team member then follows suit. The team leader coordinates the lift, and in unison, the team lifts the rebar to waist level. The rebar is then placed in the hook of the material handling device by both members of the team and carried to where it is needed. Once the team arrives at the location where the rebar is needed, the process is essentially reversed and the rebar is placed on the ground. The process is then repeated as many times as required, and once finished, the hook can then be stored by swinging it in and parallel to the side of the body.

If appropriate, iron worker tools can be attached to the belt, at the iron worker tool attachment point 52 on the belt.

While I have described the process of moving the rebar in great detail, in practice I have found that it can be performed very rapidly, efficiently, and safely.

While the above description contains many specificities, the reader should not construe these as limitations on the scope of the invention, but merely as exemplifications of preferred embodiments thereof. Those skilled in the art will envision many other possible variations are within its scope. For example skilled artisans will readily be able to change the dimensions and shapes of the various embodiments. They will also be able to make the material handling device of alternative materials such as plastic or other types of metal. They can make other changes in settings of the ball plunger and detents of 28 and 50 of FIG. 2. Alternatively, they can make changes to the belt and its features. Accordingly, the reader is requested to determine the scope of the invention by the appended claims and their legal equivalents, and not by the examples which have been given.

I claim:

1. A tool for carrying rebar or other heavy circular construction material consisting of:

a hook of semicircular shape mounted to a base of sufficient size and strength wherein can be placed rebar or other heavy circular construction material, a means of mounting said hook to the base in a manner which allows the hook to swivel, a means of providing detents which hold the hook in a stored or operational position, a customized belt adapted to be worn around the waist of a worker, and said base being mounted to said belt such that said hook depends below said belt.

2. The tool of claim 1 and further consisting of:

said belt being sufficiently wide for mounting the tool assembly, said belt being padded on an inside surface thereof for supporting heavy loads, adjustable and padded shoulder straps attached to said belt for supporting heavy loads, said belt being widened in a rear portion thereof where the belt contacts the wearers' lower back, for support, and means on said belt for attaching customary iron worker tools.

* * * * *